US010344730B2

(12) United States Patent
Grange et al.

(10) Patent No.: US 10,344,730 B2
(45) Date of Patent: Jul. 9, 2019

(54) FUEL SUPPLY SYSTEM FOR AN INTERNAL COMBUSTION ENGINE

(71) Applicant: VOLVO TRUCK CORPORATION, Göteborg (SE)

(72) Inventors: Thomas Grange, Lyons (FR); Hervé Coste, La Verpillière (FR); Baptiste Boutin, Villeurbanne (FR)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 15/023,700

(22) PCT Filed: Oct. 14, 2013

(86) PCT No.: PCT/IB2013/003055
§ 371 (c)(1),
(2) Date: Mar. 22, 2016

(87) PCT Pub. No.: WO2015/056045
PCT Pub. Date: Apr. 23, 2015

(65) Prior Publication Data
US 2016/0230733 A1 Aug. 11, 2016

(51) Int. Cl.
*F02M 37/00* (2006.01)
*F02M 37/30* (2019.01)
(Continued)

(52) U.S. Cl.
CPC ..... *F02M 69/54* (2013.01); *F02M 37/0052* (2013.01); *F02M 37/16* (2013.01);
(Continued)

(58) Field of Classification Search
CPC .... F02M 69/54; F02M 63/0225; F02M 37/16; F02M 37/223; F02M 37/221;
(Continued)

(56) References Cited

U.S. PATENT DOCUMENTS

2002/0092505 A1* 7/2002 Rembold ..... F02M 37/0052 123/464
2002/0162536 A1 11/2002 Steinbrenner et al.
(Continued)

FOREIGN PATENT DOCUMENTS

DE 102009-030500 A1 1/2011
DE 102009030500 B4 * 3/2012 ..... F02M 37/0035
(Continued)

OTHER PUBLICATIONS

JP 2013189939—English Translation.*
(Continued)

*Primary Examiner* — Joseph J Dallo
*Assistant Examiner* — Scott A Reinbold
(74) *Attorney, Agent, or Firm* — WRB-IP LLP

(57) ABSTRACT

The invention relates to a fuel supply system for an internal combustion engine comprising:—a low pressure fuel pump (18);—a low pressure supply circuit (34) through which fuel is delivered by the low pressure pump (18) to one or several high pressure circuits (16), said low pressure supply circuit (34) comprising at least one delivery connection (36) for delivering fuel to the high pressure circuit(s) (16);—a pressure regulator (54) through which excess fuel from the low pressure supply circuit (34) is discharged through the pressure regulator (54) in a pump return circuit (56) which is fluidically connected to an input (20) of the low pressure pump (18) without passing through the fuel tank (14); characterized in that the pressure regulator (54) is located downstream of the delivery connection (36), and in that a fuel derivation circuit (60) is fluidically connected to the low pressure fuel supply circuit (34) downstream of the at least one delivery connection (36) to the high pressure circuit(s) and upstream of the pressure regulator (54).

20 Claims, 3 Drawing Sheets

(51) Int. Cl.

| | |
|---|---|
| ***F02M 57/02*** | (2006.01) |
| ***F02M 63/02*** | (2006.01) |
| ***F02M 69/54*** | (2006.01) |
| ***F02M 37/16*** | (2006.01) |
| ***F02M 37/24*** | (2019.01) |

(52) U.S. Cl.
CPC ..... *F02M 37/24* (2019.01); *F02M 37/30* (2019.01); *F02M 57/02* (2013.01); *F02M 63/029* (2013.01); *F02M 63/0225* (2013.01); *F02M 63/0275* (2013.01)

(58) Field of Classification Search
CPC .. F02M 63/029; F02M 63/0275; F02M 57/02; F02M 37/0052; F02M 37/0023; F02M 37/0029; F02M 37/0058; F02M 37/30; F02M 37/24
USPC ..... 123/446
See application file for complete search history.

(56) References Cited

U.S. PATENT DOCUMENTS

2003/0233994 A1 12/2003 Larsson
2004/0261772 A1 12/2004 Larsson et al.
2008/0041341 A1* 2/2008 Kubota ..... F02M 55/025 123/456
2008/0245346 A1* 10/2008 Onishi ..... F02M 37/0058 123/514
2009/0145402 A1* 6/2009 Sano ..... F02M 37/0029 123/447
2010/0282211 A1* 11/2010 Daniel ..... F02M 47/027 123/447

FOREIGN PATENT DOCUMENTS

| | | | | |
|---|---|---|---|---|
| DE | 102009030500 | B4 * | 3/2012 | ..... F02M 37/0035 |
| DE | 102011003362 | A1 | 8/2012 | |
| EP | 1722097 | A1 | 11/2006 | |
| EP | 2249021 | A1 | 11/2010 | |
| JP | 2003532833 | | 11/2003 | |
| JP | 2005504944 | | 2/2005 | |
| JP | 2008255868 | | 10/2008 | |
| JP | 2009270471 | | 11/2009 | |
| JP | 2010261451 | | 11/2010 | |
| JP | 2013189939 | | 9/2013 | |
| JP | 2013189939 | A * | 9/2013 | |
| JP | 2013189939 | A * | 9/2013 | |
| WO | 03031852 | A1 | 4/2003 | |
| WO | 2005085625 | A1 | 9/2005 | |

OTHER PUBLICATIONS

DE 102009030500 B4—English Translation.*
JP 2013189939—English Translation (Year: 2013).*
DE 102009030500 B4—English Translation (Year: 2009).*
Japanese Official Action (dated Mar. 10, 2017) (translation) for corresponding Japanese App. 2016-522748.
International Search Report (dated Jun. 23, 2014) for corresponding International App. PCT/IB2013/003055.

* cited by examiner

FUEL SUPPLY SYSTEM FOR AN INTERNAL COMBUSTION ENGINE

BACKGROUND AND SUMMARY

The invention relates to a fuel supply system for an internal combustion engine.

The invention can be applied in connection with internal combustion engines installed in automotive vehicles, especially in heavy-duty vehicles, such as trucks, buses and construction equipment, or with internal combustion engines in fixed installations.

It is common for internal combustion engines to have high pressure injections systems where fuel is first pressurized by a so-called low pressure pump and then pressurized to a higher pressure level by one or several high pressure pumps before being injected in the cylinders of the internal combustion engine. In such systems, the low pressure pump delivers fuel to a low pressure supply circuit having at least one delivery connection to the high pressure circuit(s).

Document US-2004/0261772 describes such a system. In that system, the low pressure pump delivers fuel to a fuel gallery in which fuel pressure is regulated by a pressure regulator under the form of a combination valve. At the output of the pressure regulator, the fuel is returned to the low pressure pump via a return line without passing through the fuel tank. In such a system, it is possible to have a high recirculation rate of fuel in the low pressure supply circuit without systematically returning to the tank all the fuel recirculated. This avoids the need for the recirculated fuel to pass through the primary filter which is installed between the tank and the low pressure pump input. In the system of document US-2004/0261772, a vent line is provided which is connected to the tank. The vent line is not pressurized.

In some cases, the high pressure circuit(s) contains one or several high pressure pumps which absorb fuel in such a way that it may generate pressure variations or pulses in the low pressure supply circuit. These pressure variations or pulses may have negative effects. Also, due to the fact that the recirculated fuel goes directly back to the low pressure pump without passing through the tank, heating up of fuel at engine started is quicker. However, in certain operating conditions, the temperature of fuel circulating in the low pressure supply circuit may be somewhat too high.

It is desirable therefore to improve the above type of fuel supply circuit.

According to an aspect of the present invention, a fuel supply system for an internal combustion engine is provided comprising:

- a low pressure fuel pump to be fluidically connected to a fuel feeding circuit (12) to receive fuel from a fuel tank;
- a low pressure supply circuit through which fuel is delivered by the low pressure pump to one or several high pressure circuits, said low pressure supply circuit comprising at least one delivery connection for delivering fuel to the high pressure circuit(s);
- a pressure regulator which has an input fluidically connected to the low pressure supply circuit and an output which is fluidically connected to a pump return circuit in order that excess fuel from the low pressure supply circuit (34) is discharged through the pressure regulator in the pump return circuit, wherein the pump return circuit is fluidically connected to an input of the low pressure pump without passing through the fuel tank;

characterized in that the pressure regulator is located downstream of the at least one delivery connection to the high pressure circuit(s), and in that a fuel derivation circuit is fluidically connected to the low pressure fuel supply circuit at a derivation pick-up location downstream of the at least one delivery connection to the high pressure circuit(s) and upstream of the pressure regulator.

According to further optional features of the invention, some of which may be combined:

- in normal operation of the fuel supply system, a continuous flow of pressurized fuel is circulated in the fuel derivation circuit; The pressure being maintained in the derivation circuit at a pressure above atmospheric pressure, preferably at least one bar above atmospheric pressure, fuel circulation is warranted.
- the low pressure fuel supply circuit may comprises at least two delivery connections to the high pressure circuit(s) associated to different high pressure pumps, and the derivation pick-up location is located downstream of the at least two delivery connections to the high pressure circuit(s).
- the low pressure supply circuit may comprise at least one fuel retrieval connection to the high pressure circuit(s) where fuel from the high pressure circuit(s) is recovered in the low pressure fuel supply circuit, and the pressure regulator may be located downstream of the at least one retrieval connection to the high pressure circuit(s).
- the fuel derivation circuit may be fluidically connected to the low pressure fuel supply circuit at a derivation pick-up location which may be both downstream of the at least one delivery connection to the high pressure circuit(s), and downstream of the at least one retrieval connection to the high pressure circuit(s).
- the low pressure supply circuit may comprise at least one gallery which is thermally connected to an engine block or to an engine cylinder head, and the derivation pick-up location is located downstream of the gallery.
- the gallery may be formed in the engine block or in the engine cylinder head.—the fuel derivation circuit may have a derivation flow limiter. The derivation flow limiter may be located at a distance from the derivation pick-up location, for example at least 50 centimetres from the derivation pick-up location. The pressure of fuel in the derivation circuit, upstream of the derivation flow limiter, may be superior to the atmospheric pressure. It may be in the range of 1 to 10 bars above atmospheric pressure, preferably in the order of 1 to 5 bars above atmospheric pressure.
- the fuel derivation circuit may direct fuel to the fuel tank.
- the fuel system may comprise at least one filter and a filter heating circuit, and the fuel derivation circuit may direct fuel to the filter heating circuit.
- the fuel derivation circuit may direct fuel both to the fuel tank and to the filter heating circuit.
- the fuel derivation circuit may comprise a tank return flow limiter and the filter heating circuit may be fluidically connected to the fuel derivation circuit upstream of the tank return flow limiter.
- the filter heating circuit may have a heating circuit flow limiter.
- the fuel derivation circuit may have a check valve for preventing fluid flow from the fuel derivation circuit back to the low pressure supply circuit.
- the check valve may be located upstream of a flow limiter in the fuel derivation circuit.
- the filter heating circuit may be fluidically connected to the fuel derivation circuit downstream of the check valve for preventing fluid flow from the fuel derivation circuit back to the low pressure supply circuit.

the fuel from the filter beating circuit may be circulated through the filter:

the fuel from the filter heating circuit may be circulated proximate the filter.

the filter may be a primary filter located in the fuel feeding circuit upstream of the low pressure pump.

the fuel system may comprise comprises a fuel feed pump in the fuel feeding circuit for delivering fuel to the low pressure pump.

According to another aspect of the present invention, an internal combustion engine arrangement is provided comprising a fuel supply system including any of the above teatimes.

According to another aspect of the present invention, a vehicle equipped with an internal combustion engine arrangement is provided including any of the above features.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
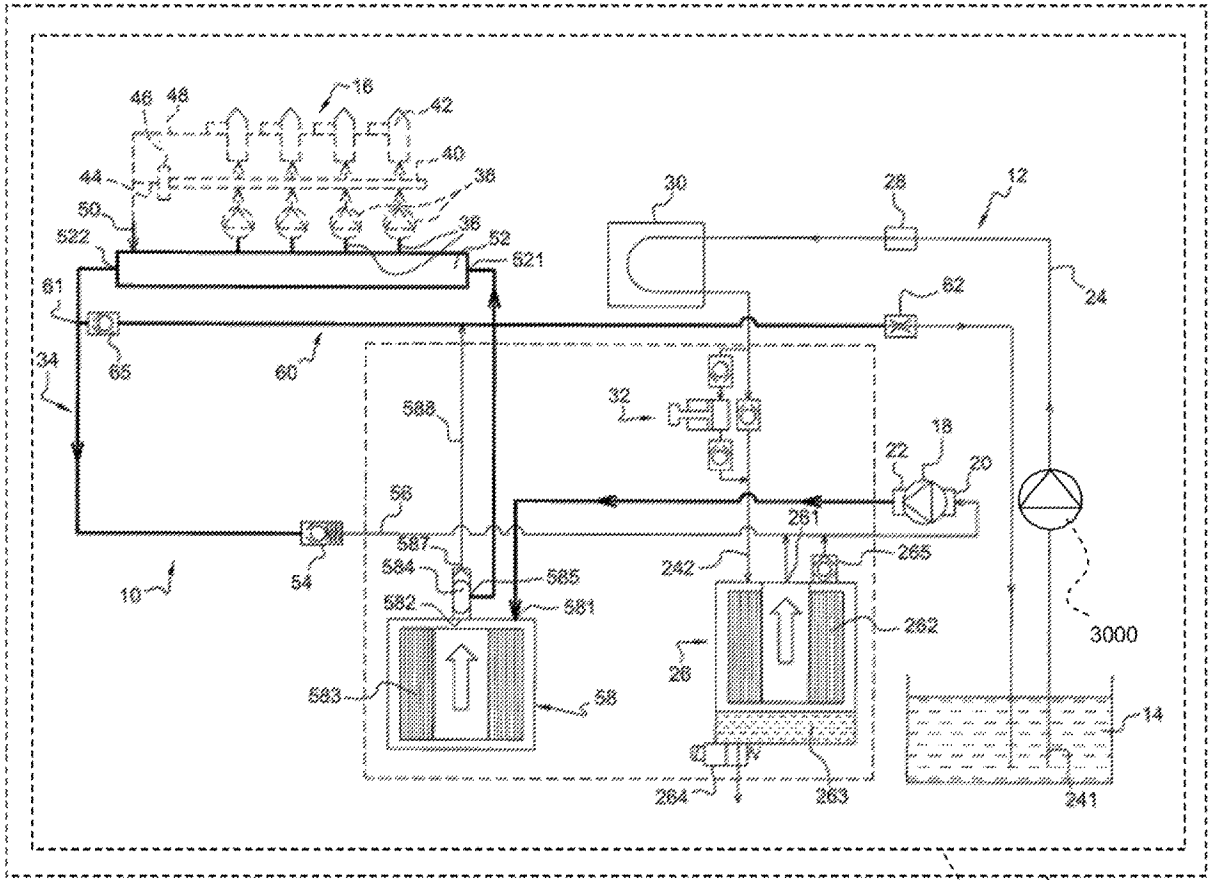
FIG. 1 is a schematic representation of one embodiment of a fuel supply system according to the invention.

On FIG. 1 is shown a fuel supply system 10 according to a tint embodiment of the invention.

The fuel supply system 10 is intended to supply fuel to an internal combustion engine, for example a multi-cylinder, 4 strokes piston Diesel engine and can thereby form an internal combustions arrangement 1000 of a vehicle 2000. The fuel supply system 10 is intended to be fluidically connected to a fuel feeding circuit 12 which is able to feed the fuel system with fuel from a fuel tank 14, such as with a fuel feed pump 3000. It is also intended to be fluidically connected to one or several high pressure circuits 16 for supplying fuel to those high pressure circuits. In the shown embodiment, the fuel supply system 10 is therefore a so-called low pressure fuel supply system which does not deliver directly fuel to the engine but only to one or several high pressure circuits comprising one or several high pressure pumps.

As can be seen from the figures, the fuel supply system comprises a pump 18, which may be called low pressure pump, having at least one fuel input port 20 and at least one fuel output port 22. The pump 18 may be mechanically driven by the engine, or it may be driven otherwise, such as by an electric motor. It can be of any type commonly used as a low pressure fuel pump in such installations, for example a gear pump. It may be a fixed displacement pump which, if driven mechanically by the engine, may deliver a flow of fuel at a flow rate proportional to the engine speed. The pump may receive fuel at its input port 20 from the fuel feeding circuit 12.

The fuel feeding circuit 12 may be a suction circuit where fuel is aspired from the tank 14 by the low pressure pump 18. In a non-shown embodiment, the fuel feeding circuit may comprise an additional feed pump for delivering fuel to the low pressure fuel pump 18. In both cases, the fuel feeding circuit 12 may comprise a feeding conduit 24 which may have an upstream extremity 241 in the fuel tank. A downstream extremity 242 of the feeding conduit 24 may be fluidically connected to an input connection of a primary filter assembly 26 having also an output connection 261. Between its input and output connections, the primary filter assembly 26 is configured to cause a flow of fuel through a filter 262 for filtering said fuel. The filter assembly 26 may act as a water separator having a water collection portion 263 at its lowermost region. The water collection portion may be equipped with a purge valve 264 for releasing water. The purge valve may be electrically controlled. Alternatively, it could be manually controlled. The filter assembly output connection 261 may be fluidically connected to the input port 20 of the low pressure pump 18 to deliver filtered fuel to the low pressure pump 18.

The fuel feeding circuit 12 may comprise a shut-off valve 28 for interrupting flow through the conduit 24.

The fuel feeding circuit may also comprise a heat exchanger portion 30 wherein the fuel may exchange heat with another device. Such device may be an electronic control unit or an electric motor. In such case, the fuel circulating in the fuel feeding conduit may be used to cool down the electronic control unit or the electric motor, at least under certain operating conditions.

The fuel feeding circuit 12 may comprise a priming pump unit 32, for example a manual priming pump unit.

The shut-off valve 28 may be located upstream of the primary filter assembly 26. The shut-off valve 28 may be located upstream of the priming pump unit 32. The priming pump unit 32 may be located upstream of the primary filter 262. In the shown embodiment, the priming pump unit 32 is located between the shut-off valve 28 and the primary filter assembly 26 on the fuel feeding conduit 24.

The low pressure pump 18 delivers pressurized fuel to a low pressure supply circuit 34 comprising at least one delivery connection 36 for delivering fuel to one or several high pressure circuit(s) 16. Therefore fuel is delivered by the low pressure pump 18 to one or several high pressure circuits through the low pressure supply circuit 34.

The high pressure circuit may comprise one or several high pressure pumps 38 delivering fuel under high pressure to an accumulator 40, which may be of the common rail type. One or several injectors 42 may be connected to the accumulator 40 for delivering pressurized fuel to the internal combustions engine. In the case of a direct injection system, the injectors 42 may be configured to inject fuel directly in the combustion chamber of the engine's cylinders. In normal operation of the system, the pressure of fuel in the high pressure circuit(s) 16 is higher than the pressure in the low pressure supply circuit 34. The temperature of fuel in the high pressure circuits 16 would typically be higher than in the low pressure supply circuit 34, due to the additional compression work in the high pressure pumps and to a potential exposure to higher temperature parts of the engine.

In a non-shown embodiment, the high pressure circuits may be in the form of several injector-pump units where one high pressure pump is directly associated to one injector.

In the present text, a circuit may comprise pipes, tubings, connectors, etc., connected to allow the circulation of a fluid inside it along a flow direction. A circuit may comprise parallel branches.

In the shown supply system, the low pressure fuel supply circuit 34 comprises at least two delivery connections 36 to the high pressure circuit(s) associated to different high pressure pumps 38. The at least two pumps may deliver pressurized fuel to the same accumulator 40, in parallel.

The high pressure circuits may comprise one or several bleed circuits for excess fuel. For example one bleed circuit 44 may be connected to the output of a high pressure regulator 46 regulating the pressure in the accumulator 40. As another example, a bleed circuit 48 may be connected to an injector 42 for collecting return fuel from the injector. One or several bleed circuits 46, 48 may be fluidically connected to the low pressure supply circuit 34.

The low pressure fuel supply circuit may comprise at least one fuel retrieval connection 50 to the high pressure circuit(s) where fuel from the high pressure circuit(s) is recovered in the low pressure fuel supply circuit. Such connection 50 may be fluidically connected to at least one of said bleeder circuits 44, 48. Preferably, a fuel retrieval connection 50 is located downstream of a delivery connection 36 in the fuel supply circuit so that fuel delivered to the high pressure circuits through that delivery connection 36 is not fuel which has just come back from the high pressure circuit, and which therefore may have been heated. Most preferably, all fuel retrieval connections 50 are located downstream of all the fuel delivery connections 36 in the fuel supply circuit. One or several bleed circuits may be joined within the high pressure circuit(s) before being connected to a same fuel retrieval connection 50 of the low pressure supply circuit 34.

The low pressure supply circuit 34 may comprise at least one gallery 52 which is thermally connected to an engine block or to an engine cylinder head. In operation, fuel circulating in said gallery 52 would then be heated by the heat accumulated in the engine block or cylinder head.

Said gallery 52 may be formed in the engine block or in the engine cylinder head, for example under the form of a cavity in the engine block or in the cylinder head. Alternatively, said gallery could be a separate component physically in contact with the engine block or with the cylinder head. Said gallery could for example be a cavity extending along an engine length alongside each of the cylinders of the engine.

Said at least one delivery connection 36 and/or said at least one retrieval connection 50 may be located at said gallery 52. As shown on the figures, in the case where the low pressure fuel supply circuit comprises several fuel delivery connections, said several fuel delivery connections 36 may be located at distinct locations along said gallery 52. The gallery 52 may have an input port 521, through which fuel is received from the low pressure pump 18, and an output port 522. All delivery and retrieval connections to the high pressure circuit(s) may advantageously be located at the gallery 52.

The fuel supply system comprises a pressure regulator 54 which has an input fluidically connected to the low pressure supply circuit 34 and an output which is fluidically connected to a pump return circuit 56 in order that excess fuel from the low pressure supply circuit 34 is discharged through the pressure regulator 54 in the pump return circuit 56. As shown in the figures, the pump return circuit 56 is fluidically connected to an input 20 of the pressure pump 18 without passing through the fuel tank 14.

In the shown embodiments, the pressure regulator 54 is located both downstream of the at least one delivery connection 36 to the high pressure circuit(s) and downstream of the at least one retrieval connection 50 to the high pressure circuit(s). The pressure regulator 54 is preferably located downstream of all fuel delivery connections 36 to the high pressure circuits. The pressure regulator may be located downstream of the gallery 52. It may be directly adjacent to the output of the gallery 52, or be installed at a distance and fluidically connected to said output 522, e.g. by a conduit.

In operation, the low pressure supply regulator 54 maintains the pressure of fuel in a portion of the low pressure supply circuit upstream of said regulator above a first pressure level. In the shown embodiment, only one pressure regulator is provided in the low pressure supply circuit 54, so that the pressure of fuel delivered to the high pressure circuits is therefore regulated by the pressure regulator 54.

However, in a non-shown embodiment, an intermediate pressure regulator, with a higher pressure setting, could be provided for example downstream of the at least one delivery connection to the high pressure circuit(s), but upstream of the pressure regulator 54, both regulators being in series in the low pressure fuel supply circuit 34.

In normal operation, the pressure of fuel at the output of the regulator 54 is lower than the pressure in the low pressure fuel supply circuit 34, i.e. lower than the first pressure level. Due to the pump suction effect, the pressure downstream of the pressure regulator 54, in the pump return line 56, may be lower than atmospheric pressure.

It can be seen in the drawings that the primary filter assembly output 261 may be fluidically connected to the fuel return circuit 56, downstream from the pressure regulator 54 but upstream of the low pressure pump input port 20. In such a case, the low pressure pump 18 receives at its input a mixture of fuel corning from the tank through the feeding circuit 12 and of fuel being directly recirculated out of the low pressure supply circuit 34 through pressure regulator 54 and fuel return circuit 56. Also, a venting output of the primary filter assembly 26, which may be equipped with a venting valve 265, can also be fluidically connected to the fuel return circuit 56 upstream of the input port 20 of the low pressure pump.

The pressure regulator 54 is exemplified in the shown embodiments as a check valve biased to a closed position and which opens if the action of pressure upstream of the regulator exceeds the action of the pressure downstream of the regulator combined with the actions of spring. The pressure regulator can be set to regulate a pressure at a first pressure level in the order of 1 to 10 bars above atmospheric pressure, preferably in the order of 3 to 5 bars above atmospheric pressure.

The low pressure supply circuit 34 may comprise a main filter assembly 58. The main filter assembly 58 may be inserted in the low pressure fuel supply circuit 34 downstream of the low pressure pump 18, but preferably upstream of any fuel delivery connection 36 to the high pressure circuits. It may have an input connection 581 connected to the output 22 of the low pressure pump 18. It may have an output connection 582 connected to the input 521 of the gallery 52. Between its input connection 581 and its output connection 582, the main filter assembly 58 is configured to cause a flow of fuel through a filter 583 for filtering said fuel. In the shown embodiment, the output 582 of main filter assembly is equipped with a three-way automatic de-aeratingvalve 584, which may be of the type described in document US2003/0233994, which is herein incorporated by reference. The de-aerating valve 584 may comprise an input connected to the output 582 of the main filter assembly 58, a fuel output 585 connected through the fuel supply circuit 34 to the input of the gallery 52, and a venting output 587 connected to a venting tube 588 for venting any gas trapped in the fuel supply circuit, especially upon priming of the circuit after replacement of the filter 583 or 262.

As shown on the figures, a fuel derivation circuit 60 is fluidically connected to the low pressure fuel supply circuit 34 at a derivation pick-up location 61 downstream of the at least one delivery connection 36 to the high pressure circuit(s) and upstream of the pressure regulator 54.

As will be shown below, the fuel derivation circuit 60 is preferably designed such that, in normal operation of the fuel supply system, a continuous flow of fuel is circulated in the derivation circuit 60.

In the first embodiment of the invention shown on FIG. 1, the derivation circuit 60 directs fuel to the fuel tank 14.

As seen in FIG. 1, a tank return flow limiter 62 may be provided on the derivation circuit 60. The tank return flow limiter 62 is installed downstream in the derivation circuit, preferably downstream of the derivation pick-up location. Preferably, the tank return flow limiter 62 limits the flow in the derivation circuit to less than 50% of the flow rate in the low pressure supply circuit just upstream of the derivation pick-up location, but preferably less than 25%. Preferably, the fluid flow in the in the derivation circuit to less than 50% of the flow rate in the low pressure supply circuit just upstream of the derivation pick-up location However, it can be understood that the derivation being downstream of the at least one delivery connection 36 to the high pressure circuit(s), this derivation does not affect the flow of fuel which circulates in the low pressure supply circuit near said connection. Therefore, since maximum flow rate is maintained near this location, any pressure fluctuation created in the low pressure power supply by the absorption of fuel by the high pressure circuit is minimized thanks to the high flow rate in the low pressure supply circuit 34 at that delivery connection 36.

The tank return flow limiter 62 may be a simple flow restriction in the derivation circuit 60, for example a calibrated orifice. However, it could also be a variable flow limiter. A variable flow limiter could be provided and could be controlled to control the proportion between the flow rate of fuel which would return to the fuel tank through the derivation circuit 60 versus the flow rate of fuel returning directly to the input 20 of the low pressure pump 18 via the fuel return circuit 56 without passing though the fuel tank.

The pressure of fuel in the derivation circuit 60, upstream of the tank flow limiter 62, may be close to the pressure regulated by the pressure regulator 54. This pressure is superior to the atmospheric pressure. It may be in the range of 1 to 10 bars above atmospheric pressure, preferably in the order of 1 to 5 bars above atmospheric pressure.

The location of the derivation pick-up location 61 corresponds to the portion of the low pressure supply circuit where fuel is substantially at its most elevated temperature. Therefore, the fuel in the derivation circuit is at a relatively high temperature.

As shown on the figures, the low pressure fuel supply circuit 34 may comprise more than one delivery connection 36, i.e. at least two such connections, to the high pressure circuit(s), each being for example associated to different high pressure pumps 38. In such a case, the derivation pick-up location 61 may preferably be located downstream of the at least two delivery connections 36 to the high pressure circuit(s), for the same reason as above.

Moreover, the fuel derivation circuit 60 may be fluidically connected to the low pressure fuel supply circuit 34 at a derivation pick-up location 61 which is both downstream of the at least one delivery connection 36 to the high pressure circuit(s), and downstream of the at least one retrieval connection 50 to the high pressure circuit(s). Thus, since fuel in the high circuit is generally at a higher temperature than in the low pressure supply circuit, this will tend to further increase the temperature of the fuel in the derivation circuit 60.

In the shown example, it can be seen that the derivation pick-up location 61 may be advantageously located downstream of the gallery 52 but upstream of the pressure regulator 54.

As shown in the figures, the derivation circuit 60 may be provided with a check valve 65 for preventing fluid flow from the derivation circuit 60 back to the low pressure supply circuit 34. The check valve 65 may be located in the derivation circuit near the derivation pick-up location 61 or at said pick-up location 61.

As shown in the figures, the venting tube 588 may be connected to the derivation circuit 60 so as to return any fluid escaping though the venting tube to the tank via the derivation circuit. Preferably, the venting tube 588 may be connected to the derivation circuit downstream of check valve 65 for preventing fluid flow from the venting tube 588 back to the low pressure supply circuit.

Figure 2:
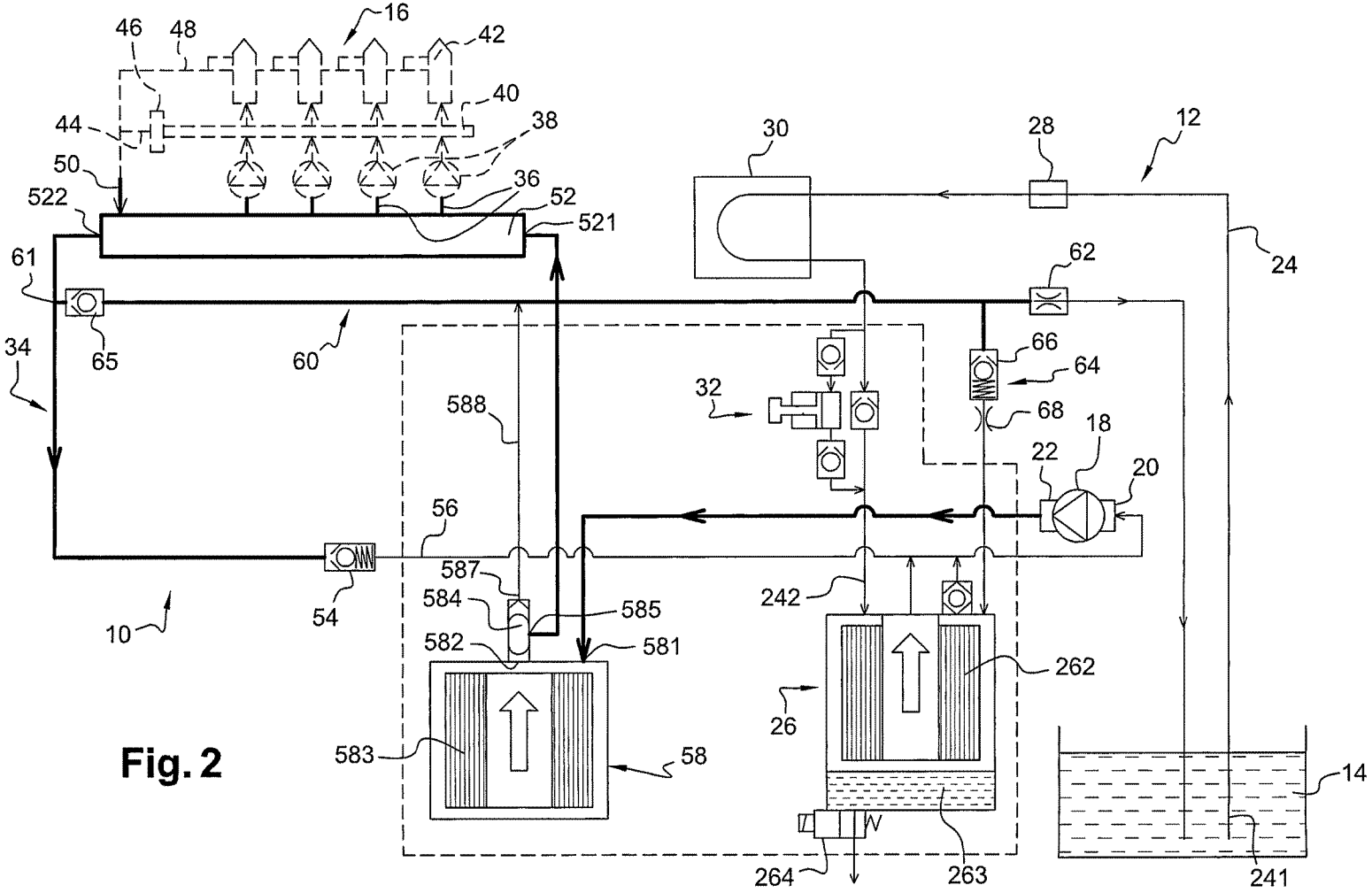
FIG. 2 is a schematic representation another embodiment of a fuel supply system according to the invention.

The second embodiment of the invention which is show on FIG. 2 contains all the above elements, which will therefore not be described a second time.

However, this second embodiment of the invention contains, in addition, a filter heating circuit 64, and the derivation circuit 60 directs fuel to the filter heating circuit 64.

More precisely, in the embodiment of FIG. 2, the fuel supply system comprises a derivation circuit 60 which directs fuel both to the fuel tank 14 and to the filter heating circuit 64.

The filter heating circuit 64 may provide beat to at least one of the filters, for example to prevent clogging of the filter by paraffin which is inherently contained in the fuel but which becomes solid at low operating temperatures. In the shown embodiment, the filter heating circuit provides heat to the primary filter assembly 26, but it could alternatively provide heat to the main filter assembly 58, or to both. Thanks to the location of the derivation pick-up 61, the fuel which is circulated in the fuel heating circuit is at a relatively high temperature, which of course increases the heating efficiency.

The filter heating circuit 64 is therefore fluidically connected to the derivation circuit 60 and may comprise a biased check valve 66 preventing back flow of fluid from the heating circuit to the derivation circuit 60. The biased check valve 66 is preferably set to open and allow fluid to flow from the derivation circuit 60 to the heating circuit 64 when the pressure in the derivation circuit 60 exceeds the pressure in the filter heating circuit 64 by a certain pressure threshold. Preferably this threshold is set between 0.3 to 1 bars, more preferably between 0.5 and 0.8 bars. Thereby, in normal operation of the system, the biased check valve 66 may be permanently open.

The heating circuit 64 may also comprise a heating circuit flow limiter 68. The heating circuit flow limiter 68 may be a simple flow restriction in the filter heating circuit 64, for example a calibrated orifice. It may be located downstream of the biased check valve 66, as shown in FIG. 2, but it could be alternatively located upstream.

In the embodiment of FIG. 2, where the derivation circuit 60 directs fuel to both the tank 14 and to the fuel heating circuit 64, and where the derivation circuit comprises a tank return flow limiter 62, the filter heating circuit 64 is preferably fluidically connected to the derivation circuit 60 upstream of the tank return flow limiter 62. Thereby, the fluid entering the fluid heating circuit is at a pressure which is approximately equal to the pressure regulated by the flow regulator 54. The pressure of fuel in the derivation circuit 60, upstream of the tank return flow limiter 62 and of the heating circuit flow limiter 68, may be close to the pressure regulated by the pressure regulator 54. This pressure is superior to the atmospheric pressure. It may be in the range of 1 to 10 bars above atmospheric pressure, preferably in the order of 1 to 5 bars above atmospheric pressure. This ensures a steady flow of fuel in the fuel heating circuit 64.

The fact that the fuel in the derivation circuit is under a pressure above atmospheric pressure allows the filter heating circuit 64 to be installed remotely from the engine while nevertheless being fed under sufficient pressure, despite any pressure loss due to the various tunings, check valve or connection in the derivation circuit. In other words, in the embodiment of FIG. 2, it is preferable to have the tank flow limiter 62 remote from the derivation pick-up location 61. The length of the derivation circuit 60 between the derivation pick-up location 61 and the tank flow limiter 62 may be superior to 50 centimetres, or preferably superior to 1 meter.

As shown on FIG. 2, the filter heater circuit 64 may be fluidically connected to the derivation circuit 60 downstream of the check valve 65 for preventing fluid flow from the derivation circuit back to the low pressure supply circuit.

In other words, the fuel derivation circuit 60 can be said to split in two parallel branches at a split location downstream of the derivation pick-up location 61, with one branch forming the filter heating circuit 64, and the other branch returning the fuel to the fuel tank 14. Each branch may be equipped with a flow limiter 62, 68.

Also, it can be seen that the fuel heating circuit may be fluidically connected to an input side of the primary filter assembly 26, so the fuel from the filter heating circuit 64 is circulated through the filter 262. This would allow most efficient prevention against filter clogging by paraffin solidified due to low external temperature. In such a case, it can be seen that the fuel from the fuel heating circuit 64 may be mixed in the fuel filter assembly 26 with fuel coming directly from the fuel tank 14 through the fuel feeding circuit 12. Preferably, mixing is performed upstream of the filter 262.

Alternatively, the fuel from the filter heating circuit may be circulated proximate the filter, for example in a flow chamber surrounding the primary filter assembly. In such a case, the fuel from the filter heating circuit 64 is not necessarily mixed with the fuel arriving to the filter assembly 26 from the tank, and the fuel from the filter heating circuit can is such a case be directed for example to the fuel tank after having circulated proximate the filter.

In the embodiments shown on the pictures, the low pressure pump 18 is a component which is clearly separate from the high pressure pump(s) 38, with no common parts. However, the invention can be implemented in a fuel supply circuit having a tandem low pressure and high pressure pump comprising a low pressure stage and a high pressure stage integrated in the same housing. In such tandem pumps, the low pressure and the high pressure stages are in general driven through a same common drive shaft.

Figure 3:
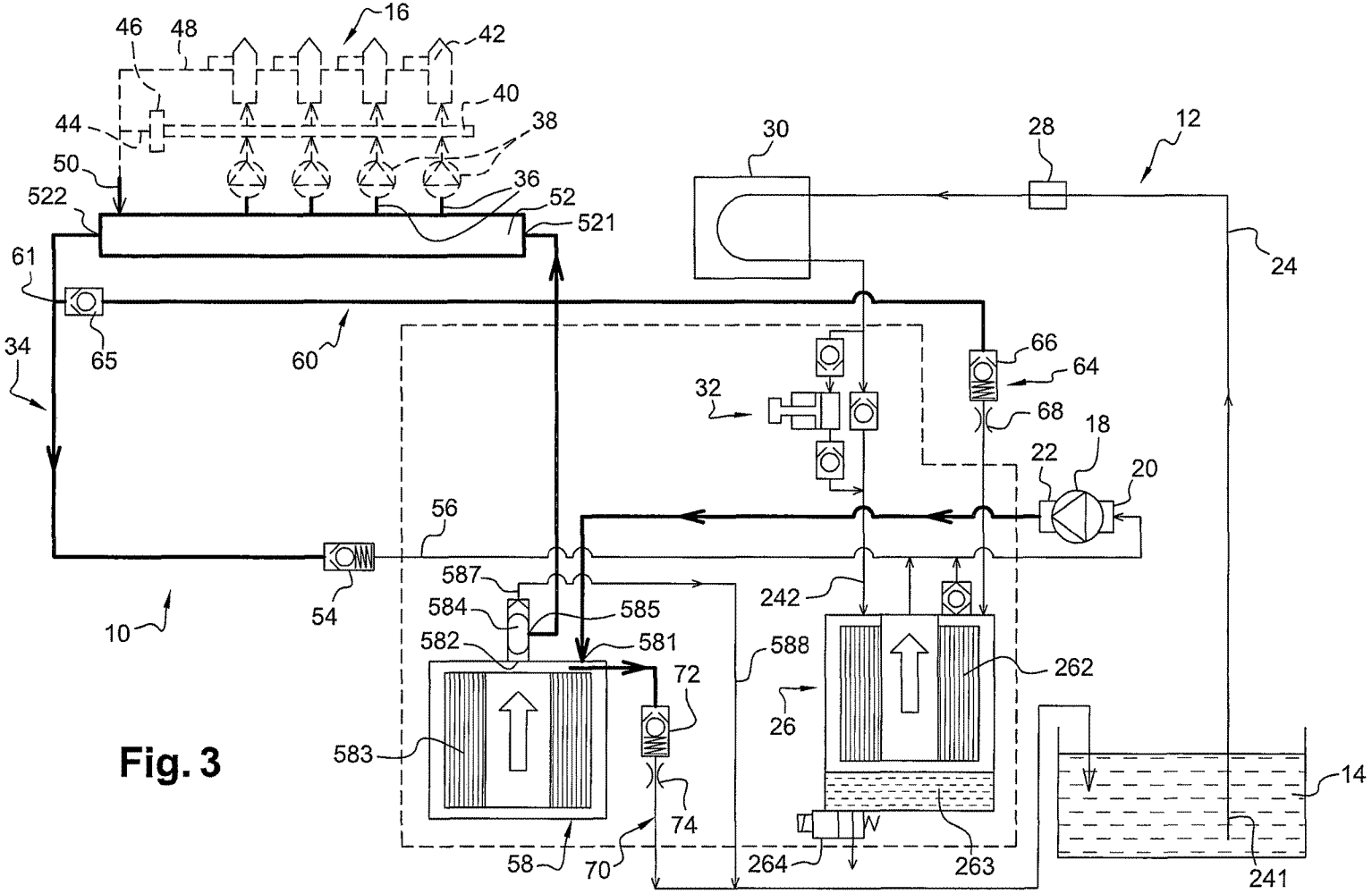
FIG. 3 is a schematic representation another embodiment of a fuel supply system according to the invention.

FIG. 3 describes a further embodiment of the invention where, compared to that of FIG. 2, the derivation circuit 60 does not direct duel to the tank 14, but only to the filter heating circuit. In other words, in this embodiment, the filter derivation circuit 60 and the fuel heating circuit 64 can be referred to jointly as only a fuel heating circuit.

The length of the derivation circuit 60 between the derivation pick-up location 61 and the heating circuit flow limiter 68 may be superior to 50 centimetres, preferably superior to 1 meter. The pressure in the derivation circuit 60 allows steady flow despite any non-desired but inevitable pressure loss in the derivation circuit. The pressure of fuel in the derivation circuit 60, upstream of the flow limiter 68, may be close to the pressure regulated by the pressure regulator 54. This pressure is superior to the atmospheric pressure. It may be in the range of 1 to 10 bars above atmospheric pressure, preferably in the order of 1 to 5 bars above atmospheric pressure.

In the embodiment of FIG. 3, one can see that a dedicated tank return circuit 70 may be provided for returning fuel to the tank 14. The dedicated tank return circuit 70 is shown to be fluidically connected to the main filter assembly 58, so as to derive fuel from the filter assembly 58, preferably upstream of the filter 583.

The dedicated tank return circuit 70 may comprise a pressure relief valve 72 in the circuit. The pressure relief valve 72 allows fuel to flow to the tank 14 through the tank return circuit only if the pressure upstream of the valve 72 in the circuit 70 exceeds a pressure level. The pressure relief valve 72 may have a setting such as it opens at a pressure level which is higher than the pressure regulated by pressure regulator 54. The dedicated tank return circuit may have a flow limiter 74. The flow limiter 74 may be set downstream of the pressure relief valve 72 in the fuel delivery circuit.

In the embodiment, of FIG. 3, one can see that the venting tube 588, connected at the venting output of the de-aerating valve 584, may be connected to the dedicated tank return circuit 70 so as to return any fluid escaping though the venting tube to the tank via the tank return circuit 70. Preferably, the venting tube 588 may be connected to the tank return circuit 70 downstream of flow limiter 74.

It is to be understood that the present invention is not limited to the embodiments described above and illustrated in the drawings; rather, the skilled person will recognize that many changes and modifications may be made within the scope of the appended claims.

The invention claimed is:

1. A fuel supply system for an internal combustion engine comprising:

a low pressure fuel pump to be fluidically connected to a fuel feeding circuit to receive fuel a fuel tank;

a low pressure supply circuit through which fuel is delivered by the low pressure fuel pump to one or several high pressure circuits, the low pressure supply circuit comprising at least one delivery connection for delivering fuel to the one or several high pressure circuits;

a pressure regulator which has an input fluidically connected to the low pressure supply circuit and an output which is fluidically connected to a pump return circuit in order that excess fuel from the low pressure supply circuit is discharged through the pressure regulator in the pump return circuit, wherein the pump return circuit is fluidically connected to an input of the low pressure fuel pump without passing through the fuel tank;

wherein the pressure regulator is located downstream of the at least one delivery connection to the one or several high pressure circuits, and wherein a fuel derivation circuit is separate from and parallel to the pump return circuit and is fluidically connected to the low pressure supply circuit at a derivation pick-up location downstream of the at least one delivery connection to the one or several high pressure circuits and upstream of the pressure regulator, wherein the low pressure supply circuit comprises at least one fuel retrieval connection to the one or several high pressure circuits where fuel from the one or several high pressure circuits is recovered in the low pressure supply circuit, and wherein the pressure regulator is located downstream of the at least one retrieval connection to the one or several high pressure circuits and is located downstream of an accumulator or rail in the one or several high pressure circuits, wherein, in normal operation of the fuel supply system, the pressure regulator maintains the pressure of fuel in a portion of the low pressure supply circuit upstream of the pressure regulator above a first pressure level, and wherein, in normal operation of the fuel supply system, a continuous flow of pressurized fuel is circulated in the fuel derivation circuit.

2. The fuel supply system according to claim 1, wherein the low pressure supply circuit comprises at least two delivery connections to the one or several high pressure circuits associated to different high pressure pumps, and wherein the derivation pick-up location is located downstream of the at least two delivery connections to the one or several high pressure circuits.

3. The fuel supply system according to claim 1, wherein the fuel derivation circuit is fluidically connected to the low pressure supply circuit at a derivation pick-up location which is both downstream of the at least one delivery connection to the one or several high pressure circuits, and downstream of the at least one retrieval connection to the one or several high pressure circuits.

4. The fuel supply system according to claim 1, wherein the low pressure supply circuit comprises at least one gallery which is thermally connected to the engine, and wherein the derivation pick-up location is located downstream of the gallery.

5. The fuel supply system according to claim 4, wherein the gallery is formed in the engine block or in the engine cylinder head.

6. The fuel supply system according to claim 1, wherein the fuel derivation circuit has a tank return flow limiter.

7. The fuel supply system according to claim 1, wherein the fuel derivation circuit directs fuel to the fuel tank.

8. The fuel supply system according to claim 1, comprising at least one filter and a filter heating circuit, and the fuel derivation circuit directs fuel to the filter heating circuit.

9. The fuel supply system according to claim 7, comprising at least one filter and a filter heating circuit, and the fuel derivation circuit directs fuel to the filter heating circuit, wherein the fuel derivation circuit directs fuel both to the fuel tank and to the filter heating circuit.

10. The fuel supply system according to claim 1, wherein the fuel derivation circuit comprises a tank return flow limiter and wherein the filter heating circuit is fluidically connected to the fuel derivation circuit upstream of the tank return flow limiter.

11. The fuel supply system according to claim 8, wherein the filter heating circuit has a heating circuit flow limiter.

12. The fuel supply system according to claim 1, wherein the fuel derivation circuit has a check valve for preventing fluid flow from the fuel derivation circuit back to the low pressure supply circuit.

13. The fuel supply system according to claim 12, wherein the check valve is located upstream of a flow limiter in the fuel derivation circuit.

14. The fuel supply system according to claim 12, wherein the filter heating circuit is fluidically connected to the fuel derivation circuit downstream of the check valve for preventing fluid flow from the fuel derivation circuit back to the low pressure supply circuit.

15. The fuel supply system according to claim 8, wherein the fuel from the filter heating circuit is circulated through the filter.

16. The fuel supply system according to claim 8, wherein the fuel from the filter heating circuit is circulated proximate the filter.

17. The fuel supply system according to claim 8, wherein the filter is a primary filter located in the fuel feeding circuit upstream of the low pressure fuel pump.

18. The fuel supply system according to claim 1, wherein it comprises a fuel feed pump in the fuel feeding circuit for delivering fuel to the low pressure fuel pump.

19. An internal combustion engine arrangement comprising the fuel supply system according to claim 1.

20. A vehicle equipped with the internal combustion engine arrangement according to claim 19.

* * * * *